US006216942B1

(12) United States Patent
Kittscher

(10) Patent No.: US 6,216,942 B1
(45) Date of Patent: Apr. 17, 2001

(54) PACKAGING FOR BULK GOODS

(75) Inventor: Peter Kittscher, Kaarst (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/308,532

(22) PCT Filed: Nov. 11, 1997

(86) PCT No.: PCT/EP97/06269

§ 371 Date: May 20, 1999

§ 102(e) Date: May 20, 1999

(87) PCT Pub. No.: WO98/22359

PCT Pub. Date: May 28, 1998

(30) Foreign Application Priority Data

Nov. 20, 1996 (DE) ..... 196 47 923

(51) Int. Cl.[7] ..... B65D 3/00; B65D 5/00

(52) U.S. Cl. ..... 229/4.5; 215/12.1; 215/383; 215/395; 215/390; 220/771; 229/101

(58) Field of Search ..... 229/4.5, 101; 220/771, 220/770; 215/383, 395, 12.1, 390

(56) References Cited

U.S. PATENT DOCUMENTS 2,723,795 * 11/1955 McKenzie ..... 206/418
5,322,184 6/1994 Bergner et al. ..... 220/771
5,503,281 * 4/1996 Bergner et al. ..... 215/12.1
5,524,787 * 6/1996 Blake et al. ..... 215/12.1

FOREIGN PATENT DOCUMENTS 39 21 258 C2 6/1995 (DE) .
44 45 213 A1 6/1996 (DE) .
0082574 * 12/1956 (DK) ..... 206/418

* cited by examiner

*Primary Examiner*—Allan N. Shoap
*Assistant Examiner*—Tri M. Mai
(74) *Attorney, Agent, or Firm*—Wayne C. Jaeschke; Kenneth Watov; Glenn E.J. Murphy

(57) ABSTRACT

A packaging system for bulk goods or material comprises a hollow polygonal blown plastic form or container for accommodating the material which is to be contained therein. A cardboard cover surrounds and is fixed to the hollow plastic form. The hollow plastic form has at least one outer edge indentation in a corner area, corresponding to a polygonal area of the cardboard cover which can be folded inside for locking or securement purposes, which is symmetrical to a corner fold line of the cardboard cover, and which is connected to the cardboard cover by at least one stamped line arranged perpendicular to the corner fold line and two fold lines forming a V-shape. The packaging system enables secure fastening between the hollow plastic form and the wrapper. To achieve this, the polygonal area of the cover is shaped as a square, and the V-shaped fold lines merge into two stamped lines culminating in a point. The corner shaped indentation is defined by flat surfaces adapting to this area of the cardboard cover, which may also be plastic, or other suitable material.

3 Claims, 3 Drawing Sheets

PACKAGING FOR BULK GOODS

BACKGROUND

1. Field of the Invention

This invention relates to a pack or packaging system for pourable goods or material, such as liquids or small free-flowing granules, and more particularly to a packaging system including an inner, polygonal blown plastic container accommodating the material to be packaged, and a sleeve-like cardboard jacket which surrounds the blown plastic container and is positively fixed thereto.

2. Discussion of Related Art

One such pack has been widely marketed by Applicants for years and has proved successful. This known pack substantially corresponds to the pack described in Applicants' DE 39 21 258 C2. In relation to that pack, the commercially available pack was further developed to the extent that at least one indentation in the blown plastic container resembles a half-drop in shape and the foldable part of the cardboard jacket is in the form of an equal-sided triangle of which two sides are arranged symmetrically to a corner fold line of the jacket in the shape of a V and are joined to the jacket via fold lines, while the third side of the triangle is arranged transversely of this corner fold line of the jacket and is in contact with the jacket via a die-cut line. Simply by pushing in this part of the jacket, it folds into the corresponding indentation of the blown plastic container and holds the jacket firmly on the container.

If, in the earlier solution, the foldable part, i.e. the triangle, is folded inwards into the indentation in the blown plastic container, the two halves of the previously horizontal side of the region slope at an angle of about 60° in relation to the vertical corner edge of the jacket. However, it has been found in practice that the blown plastic container is able to slide out of the jacket. This is attributable to the fact that, under load, i.e. when the blown plastic container shifts in the cardboard jacket, the sloping edges of the jacket lying in the indentation tend to give way outwards, creating slackness between the blown plastic container and the jacket with the result that, ultimately, the blown plastic container is able to slide out of the jacket.

SUMMARY OF THE INVENTION

With the problems of the prior art in mind, an object of the present invention is to further develop a pack of the type mentioned above in such a way that a more secure connection between the blown plastic container and the jacket is established without increased production and assembly costs, and without any danger of the blown plastic container sliding out of the plastic jacket.

According to the invention, this problem is solved by a pack of the type mentioned at the beginning which is improved by making the polygonal part of the jacket quadrangular, with the V-shaped fold lines merging into two die-cut lines which taper to a point, and further including the corner-shaped indentation being bordered by flat surfaces in adaptation to this region of the jacket.

Compared with the known pack in which the folded-in part of the jacket only rests in the drop-shaped indentation at certain points, the further development according to the present invention is distinguished by the fact that the folded-in part of the jacket lies in the cube-shaped indentation along a line or over an area in a manner providing that the complete open push-in edge of the jacket lies on the area of the depression of the container indentation. In the folded-in position, the die-cut lines taper to a point, and extend substantially horizontally and exactly adjoin the corresponding flat surface of the indentation, whereby the resulting linear positive connection is capable of absorbing far greater pressures compared to prior packaging systems. This guarantees a very secure locking effect between the blown plastic container and the jacket. The production and assembly costs of the pack are not increased because only the indentation has to be differently shaped in the blow molding process and the die cutting of the cardboard blank slightly modified.

Another advantageous embodiment of the invention includes the provision of at least two differently oriented corner-shaped indentations to provide the jacket with two foldable regions. This embodiment provides for an even more secure locking effect between the blown plastic container and the surrounding jacket.

In one particularly preferred embodiment, the corner-shaped indentations are respectively oriented towards the upper and lower ends of the blown plastic container.

BRIEF DESCRIPTION OF THE DRAWINGS

Examples of various embodiments of the invention are described in detail in the following with reference to the accompanying drawings, in which like items are identified by the same reference designation, wherein.

DETAILED DESCRIPTION OF THE INVENTION

Figure 1:
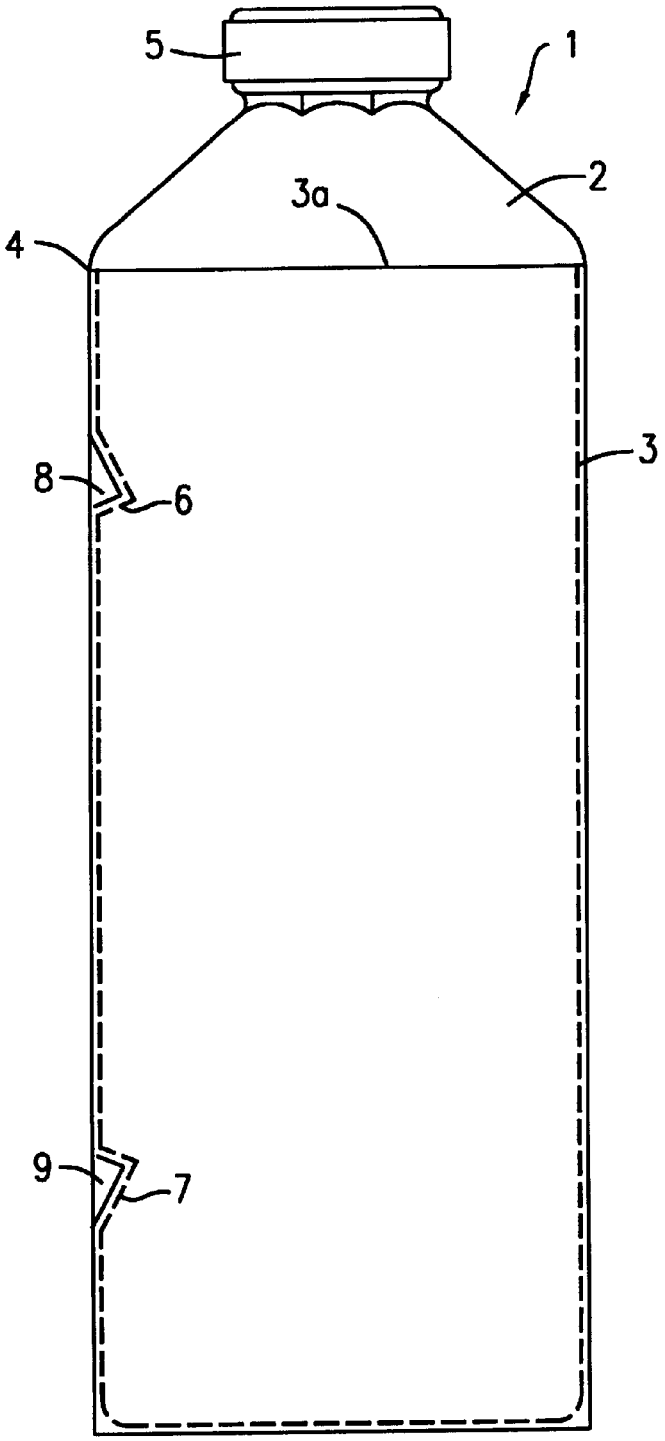
FIG. 1 is a side elevational view of a pack according to the invention.

In the illustrated embodiment, the pack generally denoted by the reference 1 consists of a blown plastic container 2 of substantially square cross-section and a sleeve-like jacket 3 of cardboard which surrounds and is positively connected to the blown plastic container 2. In the illustrated embodiment, the blown plastic container 2 has an upper supporting shoulder 4 on which the upper edge 3*a* of the jacket rests. However, the resting of the upper edge 3*a* on an upper shoulder 4 of the blown plastic container 2 is not crucial to the invention; the supporting shoulder 4 may even be omitted. The blow-molded plastic container 2 is formed on top with a product removal opening designed to be closed by a closure 5.

In one corner, the blown plastic container 2 preferably comprises two indentations 6,7 extending over its height. The exact shape of the indentations is described in more detail hereinafter. Polygonal parts 8,9 of the jacket 3, which are designed to fold inwards during assembly for locking purposes, are intended to fold inwards into the indentations 6, 7. The parts or regions 8,9 are also described in detail hereinafter.

Figure 2A:
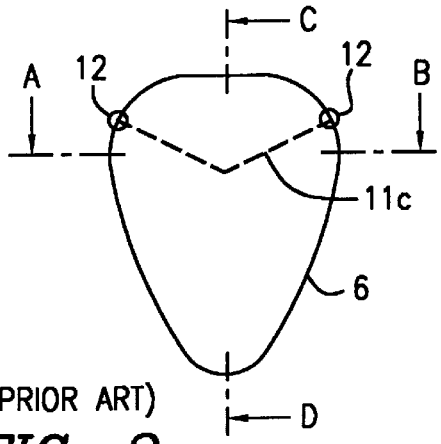
(PRIOR ART) FIG. 2a
FIG. 2*a* is a front elevational view of an indentation of the blown plastic container shown with a phantom representation of a die-cut line for an associated foldable part of the jacket of the prior art.
Figure 2C:
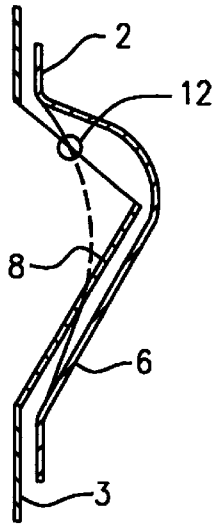
(PRIOR ART) FIG. 2c
FIG. 2*c* is a cross-sectional view taken along C-D of FIG. 2*a*, and shown additionally, is a cross sectional view of an associated foldable part of the jacket of the prior art.
Figure 2B:
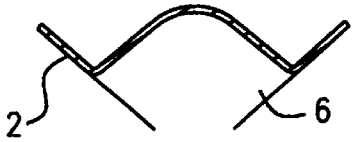
(PRIOR ART) FIG. 2b
FIG. 2*b* is a cross-sectional view taken along A-B of FIG. 2*a*.
Figure 4A:
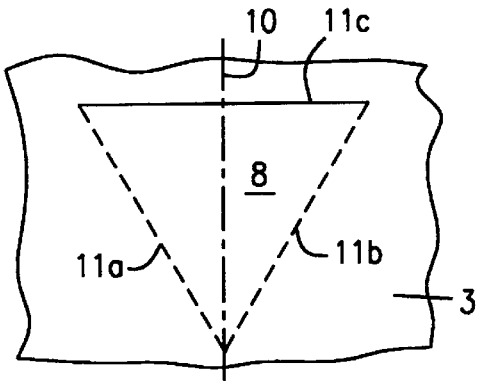
(PRIOR ART) FIG. 4a
FIGS. 4*a* and 4*b* show front elevational views of the foldable part of the jacket in the flat position, respectively, and the folded-in position in a known pack.
Figure 4B:
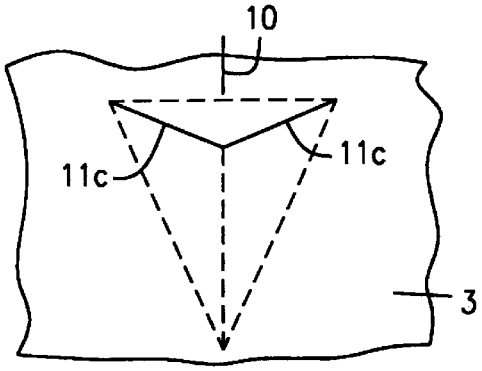
(PRIOR ART) FIG. 4b

As shown in FIGS. 2*a* to 2*c*, where FIG. 2*b* is a section on the line A-B of FIG. 2*a* and FIG. 2*c* is a section on the line C-D of FIG. 2*a* with a cross-sectional view of an associated foldable part 8, the indentation 6 of the blown plastic container 2 resembles a half-drop in shape. This is best illustrated in FIG. 2*c*. The associated foldable part 8 of the jacket 3 of a prior-art pack is shown in FIGS. 4*a* and 4*b*. The foldable part 8 of the prior-art pack is in the form of an equilateral triangle which is arranged symmetrically to a corner fold line 10 of the jacket, i.e. in such a way that the region 8 is connected to the rest of the jacket 3 by two fold lines 11*a* and 11*b* arranged in the shape of a V to one another while the ends of the fold lines 11*a* and 11*b* merge into a die-cut line 11*c* which extends transversely of the corner fold line 10.

In a known pack of the type in question, the blown plastic container 2 is inserted into the jacket 3 during the assembly of the pack 1, after which the region 8 of the jacket is pressed or turned inwards into the indentation 6 so that it lies in the indentation 6 in the manner illustrated in FIGS. 2*a* to 2*c*. It can be seen that the region 8 of the jacket 3 only touches the drop-like indentation 6 at two marginal points which are denoted by the reference 12. The pack according to the invention differs from the known pack in the shaping of the regions 8 and 9 of the jacket 3 and the indentations 6 and 7 of the blown plastic container 2, as can be seen from FIGS. 3*a* to 3*c* and 5*a* to 5*b*.

Figure 3A:
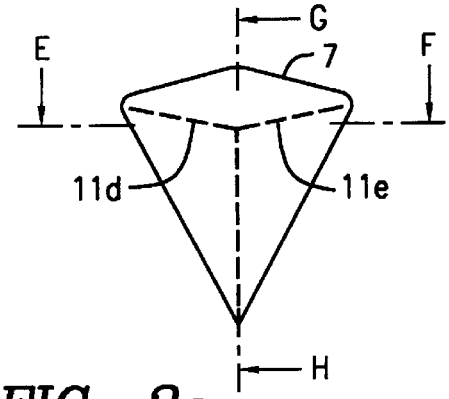
FIG. 3*a* is a front elevational view of an indentation of a blown plastic container for a pack in accordance with the present invention shown with a phantom representation of die-cut and fold lines for an associated foldable part of the jacket of the present invention.
Figure 3C:
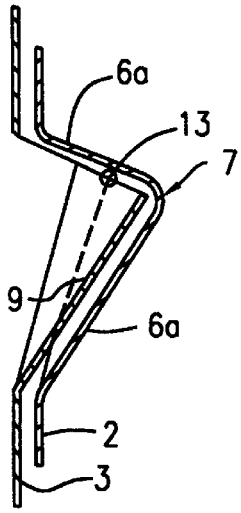
FIG. 3*c* is a cross-sectional view taken along G-H of FIG. 3*a,* and shown additionally, is a cross-sectional view of a cross-sectional view of an associated foldable part of the jacket of the present invention.
Figure 3B:
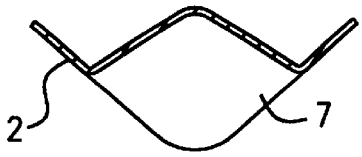
FIG. 3*b* is a cross-sectional view taken along E-F of FIG. 3*a*.

As can best be seen from FIG. 3*c*, which is a section on the line G-H of FIG. 3*a*, and a section of an associated foldable part 9, whereas FIG. 3*b* is a section on the line E-F of FIG. 3*a*, the indentations 6 and 7 of the pack according to the invention resemble the corner of a cube in shape with flat walls 6*a* so that the foldable part 8 of the jacket 3 is able almost fully to engage the indentation 7.

Figure 5A:
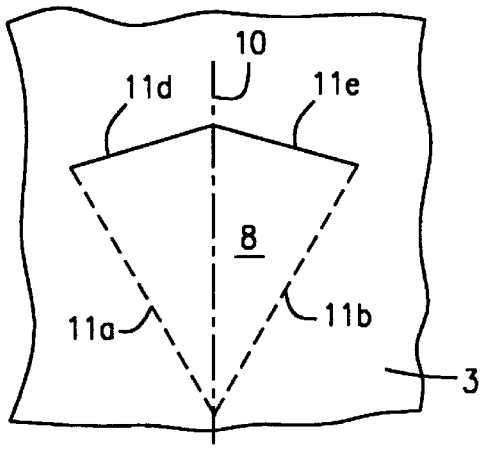
FIGS. 5*a* and 5*b* show front elevational views of the foldable part of the jacket in the flat and folded in positions, respectively, in a pack according to the invention.
Figure 5B:
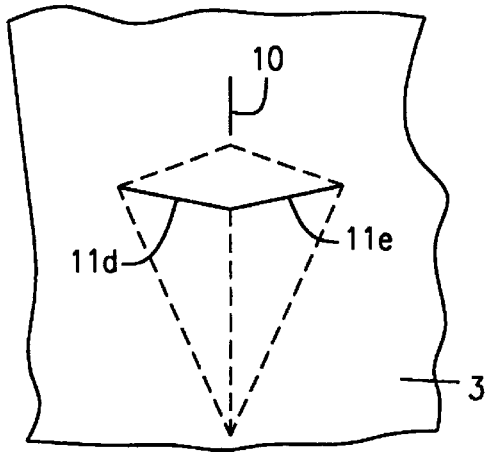

To that end, the respective regions 8 and 9 of the pack are quadrangular in shape, as can best be seen from FIGS. 5*a* and 5*b*. In contrast to the prior art, the fold lines 11*a*, 11*b*, which are disposed symmetrically to the corner fold line 10 and extend in the shape of a V to one another, do not merge into a single die-cut line, but into two die-cut lines 11*d*, 11*e* which taper to a point and which, in the folded-in position (FIG. 5*b*), together form a substantially flat edge which adjoins the associated wall 6*a* of the indentation 6 substantially linearly, as indicated by the reference numeral 13 in FIG. 3*c*.

Accordingly, the pack according to the invention represents an arrangement in which the respective indentations 6, 7 of the blown plastic container 2 are exactly adapted to the shape of the associated regions 8 and 9 of the jacket 3 with the result that, in particular, the free edges (die-cut cut lines 11*d* and 11*e*) of the regions 8 and 9 of the jacket 3 linearly adjoin the associated surface 6*a* of the indentations 6 and 7. This positive contact ensures that the jacket 3 is securely held on the blown plastic container 2.

As shown in FIG. 1, indentations 6 and 7 are provided over the height of the container with corresponding regions 8 and 9 of the jacket 3 for further improving the hold of the jacket 3 on the container 2. The indentations 6 and 7 and the regions 8 and 9 are identical in shape but are preferably oppositely directed in order to enhance the locking effect. It is particularly preferred to direct the corner-shaped indentations 6 and 7 towards the upper and lower ends, respectively, of the blown plastic container.

The invention is not of course confined to the illustrated embodiments. Other embodiments are possible with departing from the basic concept. Thus, the upper supporting shoulder 4 of the hollow body 2 may readily be omitted where two oppositely directed indentations 6 and 7 are provided. Such other embodiments are meant to be covered by the spirit and scope of the appended claims.

What is claimed is:

1. A pack for containing pourable goods including liquids, and small free-flowing granules, said pack comprising an inner, polygonal blown plastic container accommodating the goods to be packaged, and a sleeve-like cardboard jacket which surrounds the blown plastic container and is positively fixed thereto, for which purpose the blown plastic container is formed in one corner with at least one indentation in its outer edge to which corresponds a polygonal part of the cardboard jacket which is designed to fold inwards during assembly for locking purposes and which is arranged symmetrically to a corner fold line of the jacket, being connected to the jacket via at least one die-cut line extending substantially transversely of the corner fold line and at least two fold lines arranged in the shape of a V to one another, wherein the improvement comprises:

the polygonal part of the jacket in the unfolded state being made quadrangular, the V-shaped fold lines having free ends individually connected to one end of two straight die-cut lines, respectively, the other ends of said two die-cut lines being joined together at a median point above the V-shaped fold lines, and with a corner-shaped indentation of said container being bordered by flat surfaces for snugly receiving said polygonal part of said jacket.

2. A pack as claimed in claim 1, further including at least two differently directed corner-shaped indentations, and at least two associated polygonal parts of the cardboard jacket, respectively.

3. A pack as claimed in claim 2, wherein said—corner-shaped—indentations are respectively directed towards the upper end and lower ends of the blown plastic container.

* * * * *